United States Patent [19]

Lewis et al.

[11] Patent Number: 4,851,139

[45] Date of Patent: Jul. 25, 1989

[54] ISOTROPIC FABRIC SOFTENER COMPOSITION CONTAINING FABRIC MILDEWSTAT

[75] Inventors: Sheldon N. Lewis, Lafayette; Clement K. Choy, Walnut Creek; Eugene A. Mizusawa, Castro Valley; Tracey L. Casella, Martinez, all of Calif.

[73] Assignee: The Clorox Company, Oakland, Calif.

[21] Appl. No.: 90,195

[22] Filed: Aug. 26, 1987

[51] Int. Cl.[4] ..... D06M 11/00

[52] U.S. Cl. ..... 252/8.8

[58] Field of Search ..... 252/8.8

[56] References Cited

U.S. PATENT DOCUMENTS

| | | | |
|---|---|---|---|
| 3,065,123 | 11/1962 | Hinton et al. | 162/161 |
| 3,523,121 | 8/1970 | Lewis et al. | 260/306.7 |
| 3,761,488 | 9/1973 | Lewis et al. | 260/302 |
| 3,869,034 | 7/1975 | Eckert | 252/8.8 |
| 4,105,431 | 8/1978 | Lewis et al. | 71/67 |
| 4,252,694 | 2/1981 | Lewis et al. | 252/545 |
| 4,265,899 | 5/1981 | Lewis et al. | 424/270 |
| 4,417,895 | 11/1983 | Henneman | 8/137 |
| 4,424,134 | 1/1984 | Sissin | 252/8.8 |
| 4,447,343 | 5/1984 | May et al. | 252/8.75 |
| 4,454,049 | 6/1984 | MacGilp et al. | 252/8.8 |
| 4,454,146 | 6/1984 | Borovian | 424/270 |
| 4,499,071 | 2/1985 | Borovian | 424/78 |
| 4,506,081 | 3/1985 | Fenyes et al. | 548/523 |
| 4,629,574 | 12/1986 | Nuesslein | 252/8.8 |
| 4,661,269 | 4/1987 | Trinh | 252/8.8 |

FOREIGN PATENT DOCUMENTS

| | | |
|---|---|---|
| 0018039 | 10/1980 | European Pat. Off. . |
| 0079746 | 5/1983 | European Pat. Off. . |
| 0150531 | 8/1985 | European Pat. Off. . |
| 0999382 | 10/1986 | European Pat. Off. . |
| 58-21605 | 2/1983 | Japan . |
| 2007734 | 5/1979 | United Kingdom . |
| 2174423 | 11/1986 | United Kingdom . |

OTHER PUBLICATIONS

Rohm & Haas KATHON 4200 Product Brochure CS-402, Apr. 1981.

Textile Chemist and Colorist "Biocidal Rating System for Outdoor Fabrics", vol. 11, No. 3, (Mar. 1979).

Textile Chemist and Colorist "Weathering of Fabric Treated with Fungicides", vol. 10, No. 4, (Apr. 1978).

*Primary Examiner*—John F. Niebling

*Assistant Examiner*—Isabelle Rodriguez

*Attorney, Agent, or Firm*—Michael J. Mazza; Joel J. Hayashida; Stephen M. Westbrook

[57] ABSTRACT

A stable, isotropic fabric softening composition includes relatively high levels of a 2-n-alkyl-4-isothiazoline-3-one to provide immediate and residual mildewstatic activity on fabrics treated therewith. The composition also includes a quaternary ammonium or imidazolinium fabric softener having an iodine value of between about 20 and 70, an organic solvent matrix and optionally, a fatty acid soap, surfactant and pH adjusting agent, all to the promote the isotropic quality of the composition.

14 Claims, No Drawings

ISOTROPIC FABRIC SOFTENER COMPOSITION CONTAINING FABRIC MILDEWSTAT

BACKGROUND OF THE INVENTION

1. Field of the Invention

This invention relates to an isotropic liquid fabric softening composition and more particularly to a stable isotropic liquid fabric softening composition incorporating a fabric mildewstat.

2. Description of Related Art

Fabric softening compositions, in liquid or particulate form, are well known in the art and have been used in home and commercial laundering of fabrics to impart freshness and softness thereto. Typically, liquid compositions are rinse-added and contain, as an active component, a substantially water-insoluble quaternary ammonium compound, amine, or amine salt. An important consideration in formulating a fabric softening composition is that of ensuring the composition is adequately deposited onto the fabric. Adequate and uniform deposition of the composition is hampered by the varying solubilities and hydrophobicities of the materials comprising the fabric softening composition. Such materials are normally present as oil-in-water suspensions or dispersions, usually with a low content of active. Often such suspension or dispersions are not phase-stable, causing the actives to separate out. Accordingly, efforts have been made to develop phase-stable fabric softening compositions. Particularly advantageous are isotropic compositions. United Kingdom Pat. No. 2,007,734 issued to Sherman et al. describes a liquid non-aqueous fabric softener concentrate comprising a quaternary ammonium salt, an oil or a $C_{8-24}$ fatty alcohol, and optionally a nonionic or cationic surfactant. MacGilp et al., U.S. Pat. No. 4,454,049 describes an isotropic fabric softening concentrate comprising an imidazolinium fabric softener, an organic solvent and an esterified polyol.

The use of 3-isothiazolones in aqueous compositions is shown, generally, by Lewis et al., U.S. Pat. Nos. 4,015,431 and 3,523,121, which describe various 3-isothiazolones having biocidic activity at concentrations of about 0.1 to 10,000 ppm. U.S. Pat. Nos. 4,252,694 and 3,761,488, also issued to Lewis both disclose 3-isothiazolones as mildewcides and specifically the 2-n-octyl derivatives as paint (up to 0.25%), water (up to 0.1%), and laundry solution (up to 0.1%) biocides. Lewis '694 also shows the n-octyl derivatives at solution levels up to about 1% as mildewstats for paper and leather. None of the Lewis references, however, teach or suggest the use of 3-isothiazolones in an organic fabric softener matrix. Hinton, U.S. Pat. No. 3,065,123 discloses a process for the control of microorganisms in water by the addition of 1,2-benzisothiazolones. Hennemann et al., U.S. Pat. No. 4,417,895 discloses a process for the antimicrobial treatment of textiles using an azole compound. The process requires washing the textiles with a composition containing an alkyl polyglycol ether, and a quaternary ammonium salt, as well as water or organic solvents, and the azole compound may be included in the composition or separately added. Various adjuncts have been added to fabric softening compositions of the art, including antimicrobial agents. Nuesslein et al., U.S. Pat. No. 4,629,574 describes an aqueous fabric softener including quaternary ammonium or imidazolinium fabric softeners, water-miscible and water-imiscible solvents, water and an acid to adjust the pH to below 6, and may include an (unspecified antimicrobial agent. U.S. Pat. No. 4,424,134 issued to Sissin et al. describes a liquid fabric softening composition including about 0.1 to 20 ppm of 2-chloro-5-methyl-4-isothiazolin-3-one as a composition preservative. Sissin et al. is directed to improving the stability of the 3-isothiazolones in the presence of amines, and utilizes a pH of below about 6 to maintain the efficacy thereof. Fabric mildewcides incorporating about 1–7 ppm of 2-methyl-5-chloro, and 2-methyl 3-isothiazolones are described in Japanese Patent Application 58 216 05 to Mochizuki et al. These 3-isothiazolones are identified as being useful due to a high solubility in water, and a high volatility. U.S. Pat. Nos. 4,499,071 and 4,454,146 both issued to Borovian disclose fabric softening compositions including 0.2 to 1% of 5-chloro-2-methyl- and 2-methyl-3-isothiazolones as composition preservatives. European Patent Application No. 0 150 531 to Witjens describes a clay-containing fabric softening composition and mentions that 2-methyl-4-isothiazolin-3-one and its chloro derivatives can be included at levels of 0.001–.3% as a composition preservative.

The art has been limited to teaching the use of low levels (less than about 20 ppm (0.002%) in the formulation) of the 2-methyl and 5-methyl 3-isothiazolones and their chloro derivatives in aqueous solutions as solution preservatives for laundry compositions. The art is deficient in teaching the use of relatively high levels of any 3-isothiazolones in an isotropic composition, or as a laundry mildewstat having residual mildewstatic effects on fabric treated therewith. Further, it is generally accepted that the 3-isothiazolones are unstable in the presence of primary or secondary amines, which are usually present in fabric softeners.

It is accordingly an object of the present invention to provide an isotropic fabric softening composition which allows delivery of comparatively high effective levels of a fabric mildewstat.

It is another object of the present invention to provide a fabric softening composition with highly substantive fabric softening and antimicrobial materials.

It is a further object of the present invention to provide a fabric softening composition which has a residual mildewstatic effect on fabrics treated therewith.

It is a further object of the present invention to provide a stable isotropic fabric softening composition having a mildewstat incorporated therein.

Briefly, a preferred embodiment of the present invention comprises an isotropic fabric softening composition having the essential components of:

a cationic fabric softener, an organic solvent matrix; and a 3-isothiazolone mildewstat active.

The preferred fabric softener is a quaternary ammonium or imidazolinium cationic type having an iodine value of about 20 to 70 (as g of iodine/100 g of unsaturated material) and a melting point below about 25° C. Preferred organic solvents include $C_{1-4}$ alkanols, $C_{2-6}$ alkylene diols, polyols containing ethers, and mixtures thereof. The 3-isothiazolones are preferably drawn from the class of 2-n-alkyl-4-isothiazolin-3-ones, with the most preferable alkyl groups being in the six to twelve carbon range. It has been surprisingly found that when the isothiazolone is present in the isotropic fabric softening composition at significantly higher levels than found in the art, a residual mildewstatic effect exists to prevent the growth of microorganisms on fabrics treated with the composition. This mildewstatic effect effectively controls malodors on wet fabrics for up to about 168 hours, and continues to exert a long term, residual mildewstatic effect on dried fabrics. As used herein, the term "mildew" refers to any organisms or group of organisms having the tendency to produce malodors on fabrics. Stasis means the inhibition of growth of such organisms, but does not exclude the actual killing thereof.

The composition is added or released during the rinse cycle of the laundering process, and in addition to imparting a soft feel to fabrics, provides immediate high level antimicrobial activity, and continues to impart a residual mildewstatic activity to the fabrics even after drying thereof.

It is therefore an advantage of the present invention that the composition provides immediate, as well as residual, mildewstatic activity.

It is a further advantage of the present invention that a stable, isotropic composition, allowing delivery of relatively high levels of the 3-isothiazolone active, is achieved.

It is another advantage of the present invention that the composition provides a high effective-delivered amount of 3-isothiazolone active to the fabrics.

It is another advantage of the present invention that the composition remains phase-stable for an extended period.

These and other objects and advantages of the present invention will no doubt become apparent to those skilled in the art after reviewing the following Detailed Description of the Preferred Embodiment.

DETAILED DESCRIPTION OF THE PREFERRED EMBODIMENT

The preferred embodiment of the present invention comprises a stable isotropic fabric softener composition incorporating a 3-isothiazolone as a fabric mildewstat, a cationic fabric softener, a surfactant and an organic solvent matrix. The solvent matrix is specifically selected to allow formulation of the actives (principally the fabric softener and 3-isothiazolone) as a phase-stable, isotropic composition. This in turn allows high effective delivered levels of the isothiazolone, surprisingly resulting in the residual mildewstatic activity. Optional ingredients such as fragrances, brighteners, salts and additional fabric softening compounds may also be included.

Fabric Softener

The cationic fabric softener compounds of the present invention are preferably quaternary ammonium or imidazolinium compounds having at least one quaternary nitrogen atom in the molecule. The quaternary ammonium compounds are exemplified by the following structure:

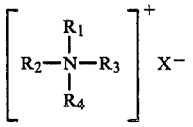

wherein $R_1$ and $R_2$ are the same or different, and are long chain saturated or unsaturated aliphatic hydrocarbon groups, each with from 14 to 26 and preferably 16 to 20 carbon atoms, and wherein $X^-$ is halide, nitrate, sulfate, methylsulfate or ethylsulfate. Preferably, $X^-$ is halide, most preferably chloride or bromide. The remaining two groups ($R_3$ and $R_4$) may be $C_{1-6}$ alkyl and/or hydroxy alkyl in which the alkyl portions thereof can be straight or branched. Optionally, the hydroxy alkyl groups can include from 1 to 6 moles of ethylene oxide. The long chain aliphatic carbon groups can be linear or branched and derived from fatty acids or fatty amines. Examples of such quaternary ammonium fabric softeners include distearyl dimethylammonium chloride, ditallow dimethylammonium chloride, dioleyl dimethylammonium chloride, ditallow methylhydroxy ethylammonium chloride, ditallow methylhydroxypropyl ammonium chloride and dimyristyl diethyl ammonium bromide. Most preferably, the $R_1$ and $R_2$ groups are derived from tallow and the $R_3$ and $R_4$ groups are methyls. Other useful fabric softeners include the imidazolinium-type exemplified by the following structure:

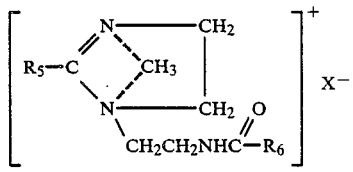

wherein $R_5$ and $R_6$ are the same or different and are selected from the group consisting of $C_{12-22}$ alkyl and alkenyl groups and wherein $X^-$ is halide, nitrate, sulfate, methylsulfate or ethylsulfate. Preferably, $X^-$ is halide, most preferably chloride or bromide. Exemplary compounds of this type include 1-methyl-1-alkylamidoethy 1-2-alkylimidazolinium methylsulfate. An example of this compound is manufactured and marketed by the Sherex Chemical Co., Inc., under the Trademark VARISOFT 3690, wherein the alkyls are derived from oleic acid. Also suitable is VARISOFT 222/LT, a methyl bis (oleoamidoethyl) 2-hydroxyethyl ammonium methyl sulfate. Mixtures of any of the foregoing fabric softeners are also suitable.

In order to formulate the fabric softening composition of the present invention in isotropic (i.e. clear, single phase) form, it is important that the fabric softener fall within a class defined by iodine number and melting point. The iodine number is a measure of unsaturation, and generally, the greater the degree of unsaturation, the more soluble the fabric softener will be in the solvent matrix of the present invention. The fabric softener should have an iodine number of between about 20 to 70, preferably between about 55 and 65. The melting point of the fabric softener is an indirect measure of the number of double bonds and degree of branching of the material. Preferably, the melting point is below about 25° C. and more preferably below about 20° C. The molecular weight of the fabric softener also affects its solubility in the organic matrix. A preferred weight average molecular weight range is between about 400 and 1000 g/mole, more preferred is between about 600 and 800 g/mole. The fabric softener will be present in a fabric softening-effective amount, and preferably from about 25 to 70%, more preferably from about 35 to 60%.

3-Isothiazolone Compounds

The 3-isothiazolone compounds used as mildewstats in the compositions of the invention have the formula:

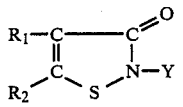

wherein Y is a substituted or unsubstituted alkyl, alkenyl or alkynl group of six to twelve carbon atoms, and most preferably is octyl. $R_1$ is hydrogen, halogen or a $C_{1-4}$ alkyl group and $R_2$ is a hydrogen or halogen. Salts of these compounds are also suitable. This class of compounds is disclosed in U.S. Pat. Nos. 4,252,694, 4,265,899, 4,105,431, 3,523,121 and 3,761,488 all issued to Lewis et al., the specifications of which are incorporated herein by reference. While several 3-isothiazolones exhibit antimicrobial activity, this activity is, in practice, limited by the substantivity and solubility of the 3-isothiazolone. Derivatives having side chains, including the 2-n-octyl derivative, are not highly water-soluble, and aqueous compositions thereof are constrained by solubility limitations in the amount of active that can be delivered. When such 3-isothiazolones are formulated in an aqueous medium, phase separation can occur, reducing the effective delivered amount of antimicrobial 3-isothiazolone and virtually eliminating the residual mildewstatic effect. To overcome this, compositions of the art tend to employ the more water-soluble derivatives, e.g., the 5-methyl and 2-chloro 3-isothiazolones. It has been surprisingly found however that the 2-n-alkyl derivatives are effective mildewstats on fabrics treated therewith, and that their high substantivity enables a high effective delivered amount of the 3-isothiazolone in an aqueous rinse solution. Further, the organic solvent matrix of the present invention enables the phase-stable, isotropic composition, containing sufficiently high levels of the 3-isothiazolone, to result in the fabric mildewstatic activity using a normal sized treatment dosage. The term "substantivity" is used to define the ability of the compound to deposit onto fabric, and is thought to be a function of the hydrophobicity of the compound.

Fabric softening compositions typically include cationic quaternary ammonium and imidazolinium fabric softeners which are soluble in organic solvents but are normally insoluble in water. It has been surprisingly found that the formulation of the present invention results in a phase-stable, isotropic fabric-softening composition, with relatively high levels (about 0.2% to 20%) of the 3-isothiazolone active present in the composition. More preferred is to formulate the composition with about 1 to 5% 3-isothiazolone. The preferred compound is the 2-n-octyl-4 isothiazolin-3-one and most preferred is such a compound manufactured and marketed by the Rohm and Haas Company and sold under the trademark KATHON 4200 (a solution of 25% active in propylene glycol). KATHON LM (a solution 5% active in propylene glycol) is also acceptable, although higher solution levels are necessary to attain equivalent concentrations of active. The isothiazolone is present in an amount sufficient to result in a residual mildewstatic effect on fabrics treated therewith, when the composition of the present invention is added to an aqueous rinse liquor in a fabric softening-effective amounts of about 0.15 to 0.75 g of composition per liter of rinse water. Typically, a 68 liter rinse solution will require about a 10–50 gram dose. Preferably the isothiazolone is present in the composition in an amount sufficient to result in about 3–80 ppm in the rinse. This requirement is satisfied by about 0.2–20% by weight of active in the composition. More preferred is about 5–10 ppm in the rinse, or about 1% to 5% in the composition.

Solvent

An organic solvent matrix is necessary to solubilize the organic components (fabric softener and 3-isothiazolone) to yield the stable isotropic composition of the present invention. Preferred organic solvents include $C_{1-14}$ alkanols such as ethanol, propanol, and isopropanol, C2-6 alkylene polyols exemplified by ethylene, diethylene, propylene, and dipropylene glycol, glycerol, and $C_{1-18}$ esters thereof. Mixtures of the foregoing are also suitable. More preferred are dipropylene glycol, glycerol and isopropanol. Glycerol also serves to increase the viscosity of the formulation, and to increase dispersibility somewhat. Especially preferred is a mixture of dipropylene glycol and glycerol. Preferably the total amount of solvent in the composition amounts to between about 10–30% by weight, more preferably between about 15 and 25% by weight. When the mixture of dipropylene glycol and glycerol is utilized, the percentage of glycerol typically will be slightly more than the percentage of dipropylene glycol. Other suitable solvents include ethanol, isopropanol, ethylene and propylene glycol as well as polyols containing ether bonds, for example, methyl ethyl butanol or diethylene glycol. Additionally, it may be desirable to add low levels of water, i.e. under about 12%, in order to aid in dissolving optional ingredients, or to lower the flash point of the composition, or as a filler. The nature of the solvent matrix allows an isotropic formulation with 3-isothiazolones other than the 2-n-octyl derivative. KATHON CGIP, for example, which is a mixture of 5-chloro, 2,4-dimethyl and 2,4-dimethyl, 3-isothiazolin-3-one, is compatible with an isotropic formulation.

Optional Ingredients

A surfactant, preferably a nonionic surfactant, may be present as a dispersing agent for the cationic fabric softener and to promote a phase-stable composition. Preferred nonionic surfactants include the ethoxylated alkylphenols, particularly those with an average chain length of 8 to 16 carbons and 2 to 20 moles of ethylene oxide per mole of alcohol. Most preferred is a nonyl phenol with 9–10 moles of ethylene oxide per mole of alcohol, such as that manufactured and marketed by the Rohm and Haas Company under the trademark TRITON N-101. Ethoxylated alkylphenols are also available from the GAF Corporation under trademark IGEPAL. Other suitable nonionic surfactants include linear or branched primary and secondary ethoxylated alcohols with an average chain length of six to eighteen carbons, and have two to ten moles of ethylene oxide per mole of alcohol. Exemplary of such surfactants are those manufactured and marketed by the Shell Chemical Company under the trademark NEODOL. In general, the surfactant chosen should have an HLB value of between about 3 to 18. Certain amphoteric surfactants, notably betaines and amine oxides falling within this HLB class can also be utilized. Exemplary of these are $C_{12-16}$ betaines or amine oxides. The surfactant is present in an amount of about 0% to 5% by weight, more preferably about 0.1–3% by weight. Low levels are preferred, as the surfactant can inhibit the softening effect of the fabric softener.

A fatty acid soap may be used to promote phase stability and the isotropic quality of the composition. The fatty acid soaps and/or their alkali metal salts that can be used herein preferably contain from 8 to 20 carbon atoms and can be saturated, unsaturated, or mixtures thereof. The alkali metal salts of fatty acids may be used either alone, or in a mixture with other alkali metal fatty acid salts or with other fatty acids. Examples of such fatty acids include coconut oil fatty acid and tallow fatty acid, preferably the alkali metal salts thereof, and most preferred is sodium tallowate. The fatty acid is present in the amount of from about .1 to 5% by weight, more preferred is about .5 to 3% by weight, and most preferred about .5 to 2% by weight. Other hydrocarbons useful for this purpose include linear or branched paraffins or olefins, especially those that are non-cyclic. These include paraffin oils, soft paraffin waxes and petrolatum, or other mineral oils. Specifically tetradecane, hexadecane, octadecane and octadecene, spindle oil, light oil, refined white oils and technical grade mixtures of $C_{14}$, $C_{17}$ and $C_{18-20}$ n-paraffins are suitable. These materials all promote isotropicity by enhancing emulsification. Nonionic fabric softeners may optionally be included in the composition. Examples of such nonionic fabric softeners include fatty acid esters of $C_{1-8}$ polyhydric alcohols or $C_{4-26}$ monohydric alcohols, and lanolins.

While the composition maintains its desired characteristics, including phase and active stability, without any adjustment to the pH (typically about 4 to 8), in order to obtain the best results from the composition of the present invention, it is preferred that the pH be adjusted to within the range of 1 to 8, preferably 2 to 7. It should be noted that because this is an organic based composition, any pH determination will necessarily be inaccurate, and should be interpreted as a range rather than a point. It will most typically be necessary to add a pH adjusting agent to attain this pH, and such a pH adjusting agent must be compatible with the other components of the composition. Preferred for this purpose are relatively weak organic acids, for example, acetic acid, citric acid and glycolic acid. Most preferred is glycolic acid as it meets all of the aforementioned criteria and is inexpensive and readily available. It is also expected that dilute inorganic acids such as HCl, $H_2SO_4$, and $H_3PO_4$ will function. Regardless of the acid used, it is added in an amount sufficient to attain the desired pH range, and accordingly the weight percent of acid is variable. If the glycolic acid is used, typically no more than from about 2.5–3% by weight is necessary. Sodium chloride may be added to improve physical stability of the formation. The composition remains stable and effective even at higher pH's (about 8), so that an alkaline pH tolerant composition could be formulated and is within the scope of the invention.

To obtain a commercially viable formulation, it is anticipated that additional optional ingredients, such as fragrances, dyes, whiteners and soluble salts for adjusting the density of the concentrate may be added. The fabric softening composition of the present invention is characterized by having a mildewstatic effective amount of the 3-isothiazolone, a fabric softening-effective amount of a quaternary ammonium or imidazolinium fabric softener, and an organic solvent in an isotropic composition.

EXAMPLE I

The following formulation exemplified a fabric softening composition of the present invention. The formulation comprises:

| Ingredient | Wt. % |
|---|---|
| Distilled Water | 7.0 |
| Solvent | 11.0 |
| 3-isothiazolone | 8.4(1) |
| Fatty acid soap | 5.0(2) |
| Surfactant | 2.0 |
| NaCl | 1.5 |
| pH adjusting agent | 2.1(3) |
| Fabric softener* | 60.0(4) |
| Fragrance | 3.0 |

(1)as 2.1% active, 6.3% propylene glycol
(2)as 1.0% active, 4.0% water
(3)as 1.47% active, 0.63% water
(4)as 45% active, 15% isopropanol
*VARISOFT 3690

EXAMPLE II

A formulation was made as described for Example I with VARISOFT 222LT as the fabric softener. Sixty weight percent of VARISOFT 222LT, as 45% active and 15% isopropanol solvent, was added to the composition, otherwise identical to Example I.

EXAMPLE III

A method for making the fabric softening composition of Example I is as follows:

A 1,000 ml, 3-neck-flask equipped with condenser, thermometer and mechanical stirrer was charged with 35 ml of deionized water. Fifty-five grams of glycerine, followed by 42.5g of KATHON 4200 were added to the flask with stirring. The flask was heated to 70° C., with continued stirring. When the temperature of the mixture reached 70° C., the heat source was removed and 25 g of sodium tallowate, 10 g of TRITON N-101 and 3.6 g of sodium chloride were added. The mixture was stirred until the temperature dropped to 50° C. 10.5 g of glycolic acid, 300 g of VARISOFT 3690 and 15 g of a fragrance were then added and stirred for four minutes to yield the desired composition, having 2.1% mildewstat active by weight.

EXAMPLE IV

A method for treating fabrics to obtain both an immediate and a residual mildewstatic effect comprises:

(a) preparing the fabric softening composition of the present invention, for example as Example I above;
(b) adding about 0.15–0.75 g of the composition per liter of water to a rinse portion of a laundering cycle, whereby the concentration of 3-isothiazolone active is between about 5 ppm and 10 ppm in a rinse solution; and
(c) removing the rinse solution.

Mildew resistance of fabrics treated in this manner is enhanced if the fabrics are subsequent fully dried, e.g., by air drying or by the use of a drier means whereby hot air and agitation are used to rapidly dry the fabrics.

EXPERIMENTAL

I. Storage Stability of 3-isothiazolone

The amount of 3-isothiazolone active remaining in the fabric softener composition after storage for various times and temperatures was determined by silica gel TLC using ethyl acetate as the eluting solvent. A reverse phase HPLC method was used to quantitate the amount of 3-isothiazolone active. Results are shown in Table 1.

TABLE 1

| Storage Condition | % active |
|---|---|
| initial | 2.13 |
| 3 months @ 0° F. | 2.16 |
| 3 months @ 70° F. | 2.10 |
| 3 months @ 90° F. | 1.95 |
| 3 months @ 120° F. | 2.08 |

These results support the conclusion that the 2-isothiazolones of the present invention are stable in the presence of the fabric softener.

II. Phase Stability of the Composition

A mildewstatic fabric softening composition was prepared in accordance with Example I. The composition was stored for 12 months at 0° F., 70° F., 90° F. and 120° F. and phase stability was determined visually. The formula was found to exhibit no indicia of phase instability at any of these temperatures. Further studies indicate that the composition will remain phase-stable at a pH ranging from acidic to about neutral. In the neutral to slightly alkaline range the composition will remain phase-stable over typical storage temperatures and shelf-lives.

III. Mildewstatic Effect of Composition

Evaluation of antimicrobial activity was carried out using two microorganisms: Aspergillus niger (ATCC 6275), and Penicillium variable (ATCC 32333). A plain-weave cotton muslin fabric was obtained from Test Fabrics, Inc. The fabric was scoured by boiling in 2 liters of distilled water containing 1.0 gram alkyl phenol polyglycoether and 1.0 gram sodium carbonate, then rinsed in boiling, followed by cold, distilled water. After drying, 25×75 mm strips were cut and sterilized by autoclaving. The strips were then soaked for three minutes in a nutrient solution and hung to dry for about 3 hours at 68° F. in a biological cabinet. The formulation of Example I (with 2.1% 3-isothiazolone active) was used to prepare samples for antimicrobial testing. Samples containing 6.2 ppm active were similarly obtained by diluting the formulation of Example 1 1:3400 with sterile distilled water. Samples of 3.1 ppm active were similarly obtained by a 1:6800 dilution. These samples were further prepared by aging at 70° F. for 3 months, or at 120° F. for 3 months. Fresh samples of the 6.2 and 3.1 dilutions were made just prior to the testing. A fresh sample of the Example 1 formulation without the 3-isothiazolone was also made up prior to the testing. Additionally, three concentrations of 3-isothiazolone active only were prepared. These were made by diluting KATHON 4200 as supplied (25% active) with propylene glycol to .25% active. This was then further diluted, with sterile distilled water to yield solutions of 3.1, 5.0 and 10.0 ppm active.

Ten swatches of fabric were placed in 100 ml of each test solution and shaken intermittently for 2 minutes (to approximate a standard washing machine rinse cycle). The excess liquid was squeezed from the swatched, where were then hung to dry for approximately three hours at 68° F. in a biological cabinet. Equal volumes of both the A. niger and P. variable suspensions were placed into a Preval spray apparatus, and both sides of the swatches were sprayed lightly with the suspension. The swatches were then suspended on hooks in 1 L jars (two swatches per jar) containing 200 ml of sterile water. The jars were capped loosely and incubated for one month at 80° F. Control swatches were treated with sterile distilled water prior to spraying with mildew solutions. All swatches were examined weekly for visible signs of mildew growth and/or staining.

Results, shown in Table 2, are given as number of positive swatches/number swatches tested. Values for the 3-isothiazolone actives represent the level in the laundry liquor and the formulations were aged as indicated prior to use. S=fabric softener, I=Isothiazolone active and S/I=both.

TABLE 2

| | 1 week | 2 weeks | 3 weeks | 4 weeks |
|---|---|---|---|---|
| S/I 3.1 ppm active | 2/10 | 9/10 | 9/10 | 9/10 |
| S/I 6.2 ppm active | 0/10 | 1/10 | 2/10 | 2/10 |
| S/I (3 mos/70° F.) 3.1 ppm active | 0/10 | 4/10 | 6/10 | 6/10 |
| S/I (3 mos/70° F.) 6.2 ppm active | 0/10 | 0/10 | 1/10 | 2/10 |
| S/I (5 mos/70° F.) 3.1 ppm active | 10/10 | N/A | N/A | N/A |
| S/I (5 mos/70° F.) 6.2 ppm active | 2/10 | 7/10 | N/A | N/A |
| S/I (3 mos/120° F.) 6.2 ppm active | 0/10 | 0/10 | 0/10 | 0/10 |
| S | 5/10 | 6/10 | 6/10 | 6/10 |
| I 3.1 ppm active | 0/10 | 1/10 | 1/10 | 1/10 |
| I 5.0 ppm active | 0/10 | 0/10 | 2/10 | 2/10 |
| I 10.0 ppm active | 0/10 | 0/10 | 0/10 | 0/10 |
| Control | 10/10 | 10/10 | 10/10 | 10/10 |

Table 2 indicates that while 3-isothiazolone levels of about 3 ppm in the rinse have some mildewstatic activity, this activity falls off during storage of the composition and it is preferred to provide a fabric softening composition capable of delivering about 6 ppm to the rinse. Assuming the fabric softening composition of Example I is added in doses of about 10 g to a washing machine containing about 68 L of water, 6 ppm of active in the rinse is attained with a fabric softener cpmposition having a 3-isothiazolone concentration of about 4.1%, which is well within the upper formulation limit of approximately 20% obtainable by the composition of the present invention.

An organoleptic test confirmed the mildewstatic effect of the formulation of the present invention. To evaluate odor build-up on wet clothing left in the washer, a load of fabrics were washed with TIDE laundry detergent (a trademarked product of the Proctor and Gamble Co.) plus the indicated additive. The fabrics (one large towel, 10 wash clothes and one tee-shirt) were washed for ten minutes in 100° F. water, then rinsed in 70° F. water over a two minute cycle. The clothes were then placed in large laundry bags and stored in a 90° F./85% RH room for five days to simulate leaving the clothes in the washing machine. After five days, the bags were opened and a panel of six people evaluated the odor of each bag. Results are shown in Table 3.

TABLE 3

| | Treatment | | | |
|---|---|---|---|---|
| | Control | Liquid Fabric Softener[1] | Example I without 3-isothiazolone | Example I with 3-isothiazolone[2] |
| Mildew Odor | Strong | Strong | Detectable | Undetectable |

[1]DOWNY, a trademark of the Procter and Gamble Company
[2]6 ppm 2-n-octyl-4-isothiazolin-3-one in the rinse While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

We claim:

1. An isotropic fabric softening composition comprising:

(a) a cationic fabric softener, present in a softening effective amount;

(b) a 4-isothiazolin-3-one compound, having a six to twelve carbon alkyl, alkenyl or alkynl group on the nitrogen, present in an amount of at least about 0.2% and (c) an organic solvent in an amount sufficient to solubilize the 3-isothiazolone compound and fabric softener, whereby a stable isotropic composition results.

2. The composition of claim 1 wherein the cationic fabric softener is selected from the group consisting of quaternary ammonium compounds, and imidazolinium compounds, having an iodine value of between about 20 to 70 and a melting point less than about 25° C., and mixtures thereof.

3. The composition of claim 1 wherein the solvent is selected from the group consisting of $C_{1-14}$ alkanols, $C_{2-6}$ alkylene polyols, and $C_{1-8}$ esters thereof, and mixtures thereof.

4. The composition of claim 1 and further including a surfactant, selected from the group consisting of ethoxylated aliphatic alcohols, ethoxylated alkylphenols and mixtures thereof.

5. The composition of claim 1 wherein the 3-isothiazolone compound is present in an amount of between about 0.2% and 20% by weight of the composition.

6. The composition of claim 1 and further including about 0.1–5% of a fatty acid of between about eight and twenty carbons in length.

7. The composition of claim 1 and further including a pH adjusting agent, present in an amount to result in a pH of the composition of between about 1 and 7.

8. A stable isotropic fabric softening composition comprising:

(a) a cationic fabric softener, having an iodine value of between about 20 and 70 and a melting point of less than about 25° C., and present in a softening-effective amount;

(b) at least about 0.2% of a 4-isothiazolin-3-one compound having a six to twelve carbon alkyl, alkenyl or alkynl group on the nitrogen;

(c) sufficient of an organic solvent, selected from the group consisting of $C_{1-4}$ alkanols, $C_{2-6}$ alkylene polyols and $C_{1-18}$ esters thereof, and mixtures thereof, to solubilize the fabric softener and 3-isothiazolone whereby a stable isotropic composition results; and (d) 0 to about 12% water.

9. The composition of 8 and further including about 0.1-5% of a fatty acid of between about eight to twenty carbons in length.

10. The composition of claim 8 wherein the 3-isothiazolone compound is present in an amount of between about 0.2% and 20% by weight of the composition.

11. A method of treating fabrics to impart softness and to control microorganism growth thereon, the method comprising:

(a) preparing an isotropic liquid mixture of a solubilizing-effective amount of an organic solvent, a 4-isothiazolin-3-one compound having a six to twelve carbon alkyl, alkenyl or alkynl group on the nitrogen, present in an amount of at least 0.2% by weight of active, and a softening-effective amount of a cationic fabric softening compound;

(b) dispersing sufficient of the mixture of (a) into a quantity of water sufficient to wet a quantity of fabrics to be treated whereby the 2-isothiazolone active is present in amount of at least about 3 ppm in said quantity of water;

(c) combining the fabrics with the water dispersion, and allowing the fabrics to remain in contact therewith for a time sufficient to soak the fabrics; and (d) removing the fabrics from contact with the water and allowing them to dry.

12. The method of claim 11 wherein sufficient of the mixture is added to said quantity of water such that the 3-isothiazolone active level is between about 5 and 10 ppm by weight in said quantity of water.

13. The method of claim 11 wherein the solvent is selected from the group consisting of $C_{1-14}$ alkanols, $C_{2-6}$ alkylene polyols, and $C_{1-18}$ esters thereof, and mixtures thereof.

14. A stable isotropic fabric softening composition comprising (a) about 25 to 70% of a cationic fabric softener having an iodine value between about 40 and 70 and a melting point below about 25° C., and selected from the group consisting of:

(i) quaternary ammonium compounds having the following structure:

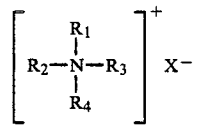

wherein $R_1$ and $R_2$ are the same or different and are $C_{14-26}$ alkyl or alkenyl, and $R_3$ and $R_4$ are $C_{1-6}$ alkyl, hydroxyalkyl or ethoxylated hydroxyalkyl, and $X^-$ is halide, nitrate, sulfate, methylsulfate or ethylsulfate;

(ii) imidazolinium compounds having the following structure:

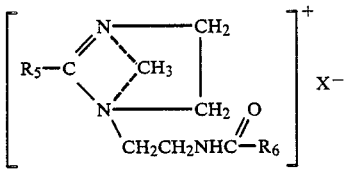

wherein $R_5$ and $R_6$ are the same or different and are $C_{12-22}$ alkyl or, alkenyl groups and $X^-$ is halide, nitrate, sulfate, methylsulfate or ethylsulfate; and (iii) mixtures thereof;

(b) at least about 0.2% of a 2-n-alkyl 3-isothiazolin-4-one having a six to twelve carbon alkyl group; and (c) sufficient of an organic solvent to result in an isotropic composition, the organic solvent being selected from the group consisting of $C_{1-14}$ alkanols, $C_{2-6}$ alkylene polyols, and $C_{1-18}$ esters thereof, and mixtures thereof.

* * * * *